United States Patent [19]

Frater

[11] 4,161,261

[45] Jul. 17, 1979

[54] SECURITY CONTAINER

[75] Inventor: James J. Frater, Watertown, Wis.

[73] Assignee: Menasha Corporation, Neenah, Wis.

[21] Appl. No.: 903,253

[22] Filed: May 5, 1978

[51] Int. Cl.[2] ..... B65D 43/14; B65D 51/04

[52] U.S. Cl. ..... 220/337; 220/343; 206/508

[58] Field of Search ..... 220/334, 335, 337, 339, 220/342, 343, DIG. 15; 206/508, 511; 229/44 R

[56] References Cited

U.S. PATENT DOCUMENTS

| | | | |
|---|---|---|---|
| 2,762,076 | 9/1956 | Kiba | 220/343 |
| 3,463,345 | 8/1969 | Bockenstette | 206/508 X |
| 3,979,016 | 9/1976 | Frater | 220/334 X |
| 4,018,338 | 4/1977 | Lemkin | 206/508 X |

*Primary Examiner*—George T. Hall

*Attorney, Agent, or Firm*—Andrus, Sceales, Starke & Sawall

[57] ABSTRACT

A security container having integral hinged lid sections which can be locked to the container to prevent tampering or pilferage of the contents. The lid sections are hinged to opposite sides of the container wall to enable each lid section to be pivoted between a downwardly hanging storage position and a generally horizontal closed position, where the lid sections enclose the open end of the container. The free longitudinal edge of each lid section is formed with a flap which projects beyond the center line of the container and extends slightly more than one-half the length of the lid section. The projecting flap of each lid section is adapted to overlie a recessed flap on the other lid section to provide a complete enclosure for the open upper end of the container. Aligned holes extend through the overlapping end edges of the lid sections, as well as through the rim of the container and are adapted to receive a lock or other security device. The closed lid sections provide a flat supporting surface to support a second stacked container, and upstanding projections are provided on the lid sections to serve as curbs to prevent displacement of the upper stacked container. Alternately, the lid sections can be secured in closed position by bands or straps and the hinges are interrupted to permit the bands to lie flat against the closed lid sections.

16 Claims, 7 Drawing Figures

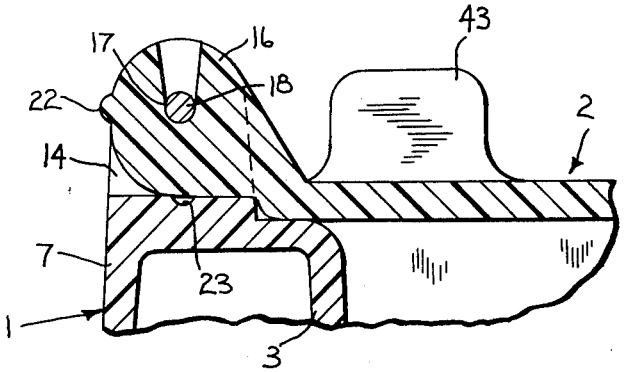
Fig. 4
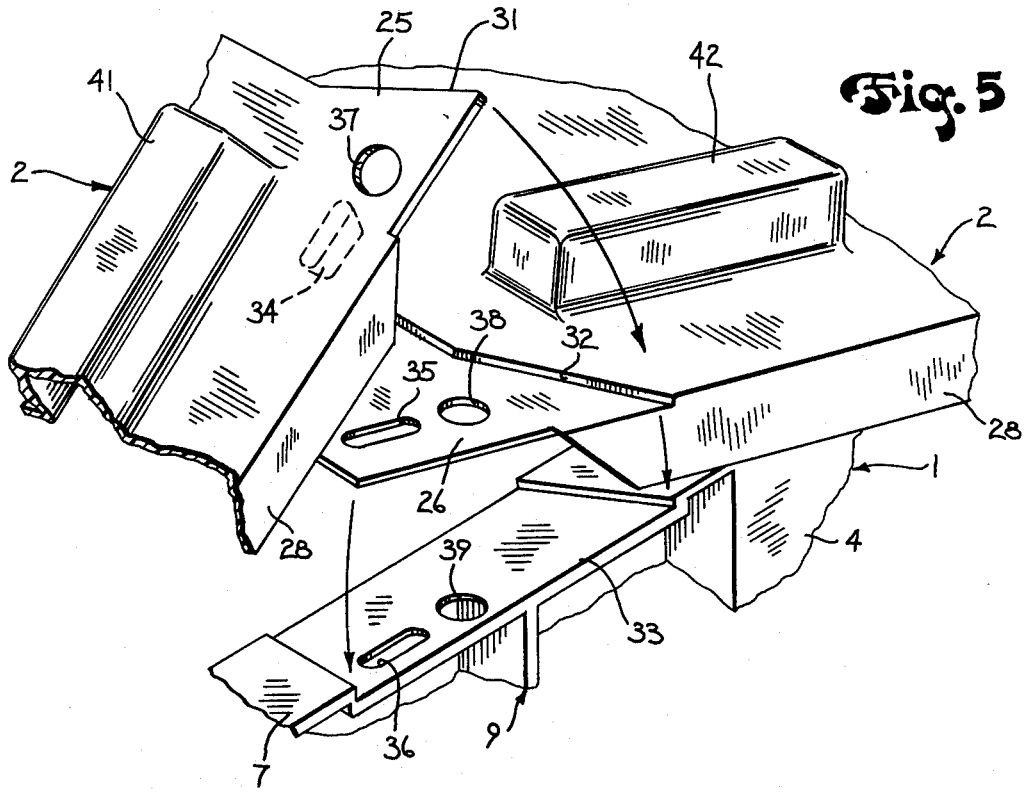
Fig. 5
Fig. 6
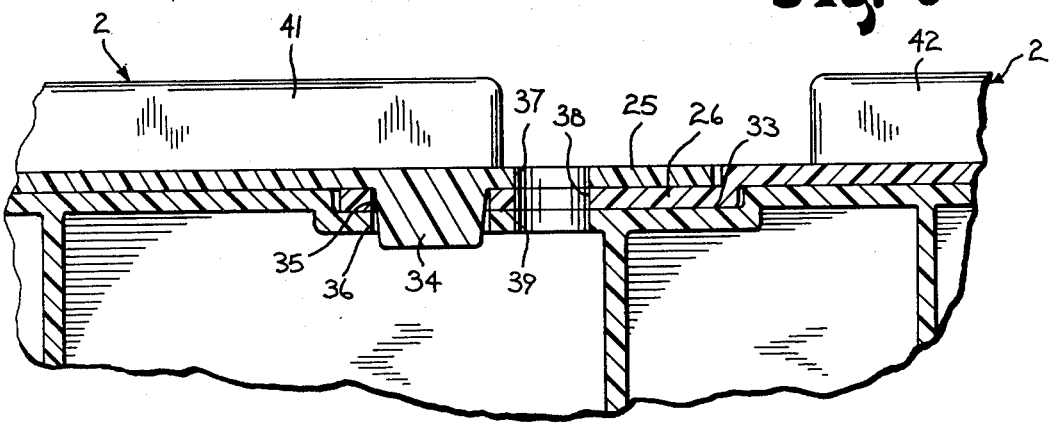

SECURITY CONTAINER

BACKGROUND OF THE INVENTION

Various types of components or products are frequently shipped from site-to-site in tote boxes or containers. The containers are commonly a nesting type in which the side and end walls of the container converge downwardly and inwardly to permit the empty containers to be nested for storage.

To prevent tampering or pilferage of the contents, the containers in some cases have been provided with lids that can be locked to the container. For optimum acceptability, the lids should be integrally connected to the container so that the lid will not be lost or misplaced when the empty containers are returned. In addition, the lids should completely enclose the open top of the container and be lockable to the container, and yet when the container is empty, the lid should not interfere with the nesting relationship of the containers.

For economic considerations, the container and lid should be of simple design and should be capable of being molded of plastic materials.

In addition to the lid being locked to the container to prevent pilferage of the contents, the lid should also be interconnected with the container in a manner such that bulging or deformation of the side walls of the filled container will be prevented to prevent gaps being formed between the lid and the container wall and the resulting exposure of the contents.

U.S. Pat. No. 3,463,345, is directed to a container having lid sections which can be locked to the container. With the container of the aforementioned patent, the free edge of each lid section is provided with a series of spaced fingers or projections which interfit with fingers of the opposite lid section to provide a closure for the open end of the container.

In the container construction, as described in the aforementioned patent, the central portions of the lid sections are depressed to form a recess to receive the lower end of an upper stacked container.

The container, as described in the U.S. Pat. No. 3,463,345, has certain disadvantages, one being that it requires a certain ability on the part of the operator to inerlock the fingers of the two lid sections in order to provide the closure. Furthermore the multiplicity of fingers require a substantial tooling cost and are subjected to damage during use. As the lid sections are provided with a recess to receive an upper stacked container, the container construction is not suited to banding in which a band is wrapped around the container to lock the lid to the container. The banding would extend across the recess in the lid sections and prevent the bottom of the upper stacked container from being received within the recess.

SUMMARY OF THE INVENTION

The invention is directed to an improved security container having integral hinged lid sections which can be locked to the container to prevent tampering or pilferage of the contents. In accordance with the invention, the lid sections are hinged to opposite side walls of the container to permit each lid section to be pivoted between a downwardly hanging storage position and a generally horizontal closed position. The free longitudinal edge of each lid section is formed with a flap or tab which extends slightly more than one-half of the length of the lid section and projects laterally beyond the center line of the container. The projecting flap of each lid section is adapted to overlie a recessed flap on the other lid section to provide a complete enclosure for the open upper end of the container.

To prevent horizontal movement or skewing of the closed lid sections with respect to the container, the end of each lid section is provided with a downwardly extending flange which, when the lid sections are closed, is located outwardly of the rim of the container. In addition, the projecting flap of each lid section is provided with a diagonal projection which is received within a diagonally extending recess in the opposite lid section to provide a dovetail-type of connection between the ends of the lid sections to prevent skewing of the lid sections.

The lid sections can be locked to the container by insertion of a padlock or other security device through aligned openings formed in the overlapping lid sections, as well as in the rim of the container. Alternately, the lid sections can be locked to the container through use of banding in which a band or strap is wrapped around the container and locked. To permit the band to lie flat against the upper surfaces of the closed lid sections, the hinge connections between the lid sections and the container are interrupted and the band is adapted to pass through the interruptions in the hinge connections.

The closed lid sections provide a flat supporting surface to support a second stacked container, and a series of upstanding projections are formed on the lid sections and serve as curbs to prevent displacement of the upper stacked container.

As the lid sections each include a single projecting flap or tab which extends approximately one-half the length of the lid section, the tooling costs are reduced over containers having a multiplicity of fingers on the free edge of the lid section. Furthermore, the design of the invention is less prone to snags and has greater strength than prior lid constructions.

In the container of the invention both overlapping lid sections are locked to the rim of the container through use of a security device thereby providing a more tamper-proof container because three material thicknesses are locked together, rather than two, as in the conventional type of container.

The container is compatible with banding systems in that the band or strap can pass through the interruption in the hinge connection and will lie flat against the upper surfaces of the closed lid sections and not interfere with the stacking of a container on the lid sections.

Other objects and advantages will appear in the course of the following description.

DESCRIPTION OF THE DRAWINGS

The drawings illustrate the best mode presently contemplated of carrying out the invention.

In the drawings:

FIG. 4 is a section taken along line 4—4 of FIG. 2;

FIG. 5 is a perspective view showing the overlapping flap construction;

FIG. 6 is a section taken along line 6—6 of FIG. 2;

DESCRIPTION OF THE PREFERRED EMBODIMENT

Figures 1, 3, 7:
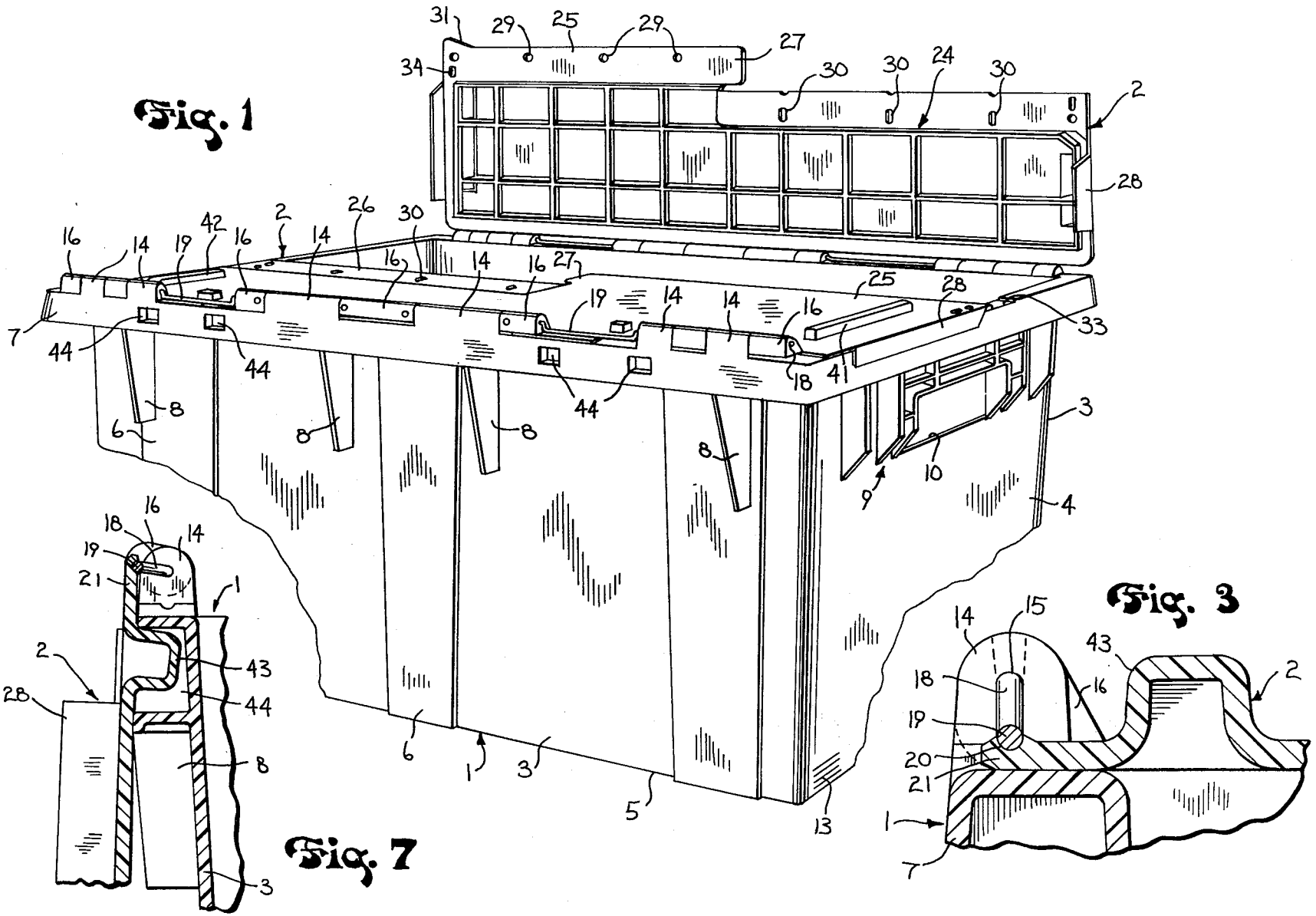
FIG. 1 is a perspective view of the container assembly of the invention showing one of the lid sections in an open position and the other in the closed position.
FIG. 3 is a section taken along line 3—3 of FIG. 2.
FIG. 7 is a view similar to FIG. 3 and showing the lid section in the downwardly hanging position.
Figure 2:
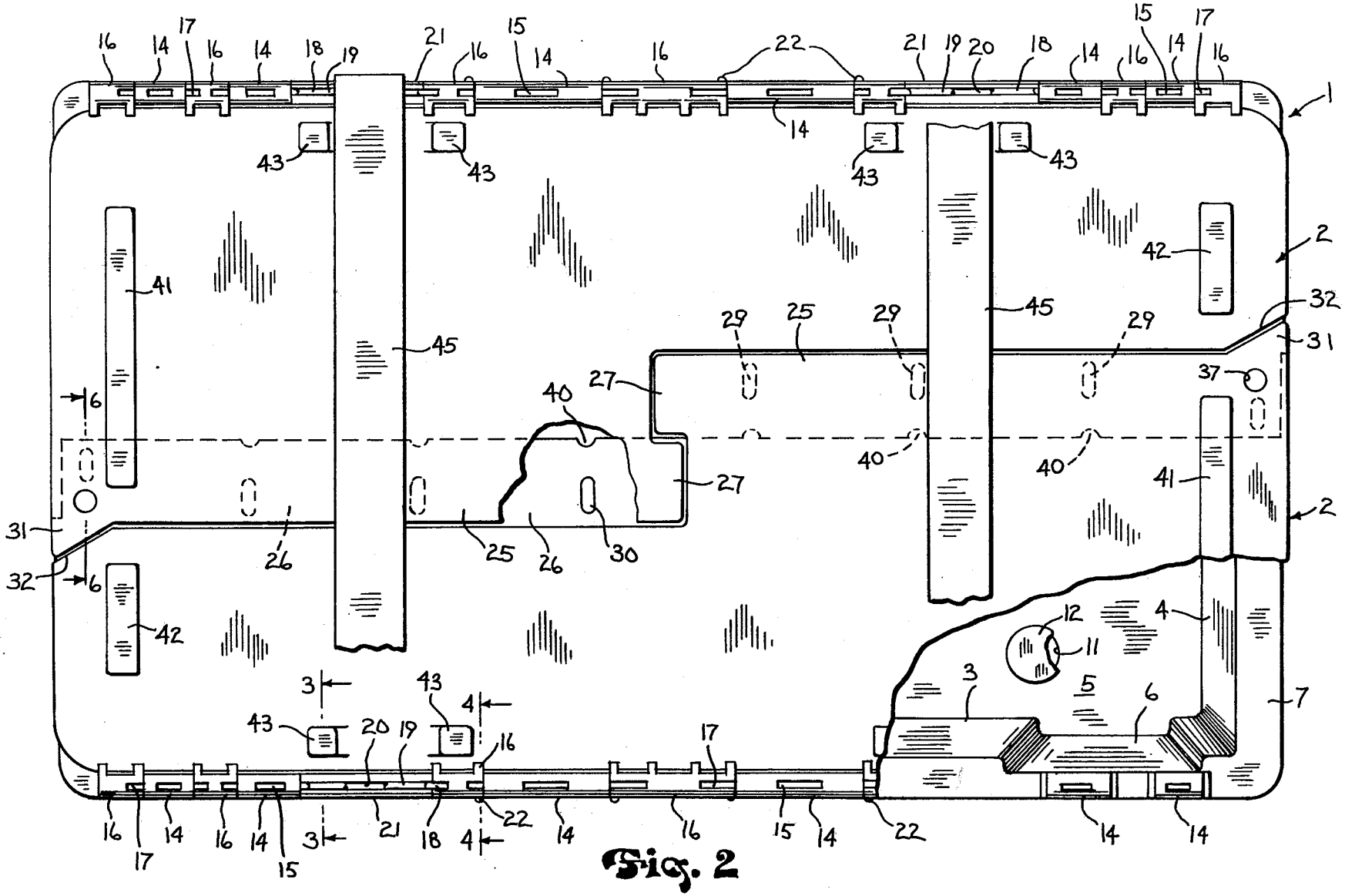
FIG. 2 is a top view of the container assembly with the lid sections in the closed position and parts broken away in section.

The drawings illustrate a tote box or container 1 having a pair of lid sections 2 hinged to opposite walls of the container. The container includes a pair of side walls 3, a pair of end walls 4 and a bottom wall 5 which connects the lower ends of the side walls and end walls. The side walls and end walls converge downwardly and inwardly to enable like containers to be nested one within the other for storage purposes.

To provide added rigidity for the walls, the side walls 3 are formed with a series of convolutions or ribs 6.

The upper ends of the side walls 3 and end walls 4 are provided with a downwardly extending flange or rim 7 and a series of ribs 8 connect the rim 7 with the outer surface of the walls 3 and 4 and serve as nesting stops. In addition, each end wall 4 is provided with a reinforcing rib structure, indicated generally by 9, which borders a hand-hole 10 in each end wall.

One or more openings 11 can be provided in the bottom wall 5 to receive a rubber grommet 12 which projects downwardly beyond the lower surface of the bottom wall 16. The grommet 12 increases the frictional resistance between the container and a supporting conveyor, not shown.

As best illustrated in FIG. 1, the lower portions of the end walls 4 are formed with a series of parallel ribs or serrations 13 which aid in enabling the container to transfer from one endless belt conveyor to the next. The ribs 13 on the leading end of the container will engage the downstream conveyor belt and help the container in climbing onto the downstream conveyor.

To hinge the lid sections 2 to the side walls 3 of container 1 a series of hinge members 14 are formed integral with the side walls 3 and project upwardly from the side wall. The hinge members 14 are provided with aligned openings or passages 15. Similar hinge members 16 are provided on the longitudinal edge of each lid section 2 and the hinge members 16 are also provided with longitudinal openings 17. A hinge pin or rod 18 extends through the aligned openings 15 and 17 and serves as a pivot to hinge the lid sections to the respective side walls 3. As best illustrated in FIG. 1, there are a pair of gaps or interruptions between the hinge connections at each side edge of the lid sections and the hinge pins 18 are provided with downwardly off-set portions 19 which are located within the interruptions. The offset portions 19 of the hinge pin 18 are adapted to rest within grooves 20 formed in outwardly extending extensions 21 in the lid sections. With this construction, the offset portions 19 of the hinge pins 18 are substantially flush with the upper surfaces of the lid sections 2. The pin 18, as inserted within the openings 15 and 17, is straight and is subsequently deformed to provide the offset portions 19. The use of the continuous pin 18 provides greater strength for the connection and the offsets 19 prevent the pin from being pulled out of the openings 15 and 17.

The lid sections 2, by virtue of the hinge connections, are adapted to be pivoted from a downwardly hanging storage position, as shown in FIG. 7, to a generally horizontal closed position where the lid sections enclose the upper end of the container 1. A provision is also made to lock the lid sections 2 in the vertical open position and in this regard, the hinge members 16 are provided with projections or ribs 22 which are adapted to engage notches 23 located adjacent hinge members 14 in the container 1. Engagement of the projections 22 with the notches 23 will hold the respective lid sections in a vertical open position for insertion and removal of materials from the container.

As illustrated in FIG. 1, the undersurface of each lid section 2 is provided with a reinforced rib structure which is in an egg-crate configuration and is indicated generally by 24.

In accordance with a feature of the invention, the longitudinal edge of each lid section 2 is provided with a flap or tab 25 which projects laterally beyond the center line of the container and extends longitudinally slightly more than one-half of the length of the lid section. In addition to the flap 25, the longitudinal edge of each lid section is provided with a second recessed flap or tab 25. The flap 26 extends slightly more than one-half the length of the lid and the outer longitudinal edge of the flap is located along the center line of the container.

As best shown in FIG. 5, the flap 26 is depressed or recessed relative to the upper surface of the lid section, with the depth of the depression being substantially equal to the thickness of the flap 25, so that when the lid sections are closed the flap 25 on each lid section will overlie the recessed flap 26 of the opposite lid section and the upper surfaces of the lid sections will provide a generally flat or planar support.

Each of the flaps or tabs 25 is provided with a nose portion 27 which projects in a longitudinal direction beyond the transverse center line of the container. The nose portions 27 of each lid section overlie the inner end of the recessed flaps 26 of the opposite lid section and interlock with each other to provide a positive closure for the center area of the container.

Extending downwardly from the end edge of each lid section 2 is a side flange 28 which, when the lid sections are in the closed position, is located outwardly of the rim 7 of the container.

In order to interlock the closed lid sections 2, the undersurface of each flap 25 is provided with a series of downwardly extending projections 29 which are adapted to be received within holes 30 in the flap 26 of the opposite lid section when the lid sections are in the closed position. In addition to the interlocking projections 29 and holes 30, a dovetail connection is provided between the lid sections to prevent the closed lid sections from moving in a horizontal plane relative to each other or skewing. In this regard, each flap or tab 25 is provided with a generally diagonal projection 31 which overlies an angular recess 32 in the flap 26 on the opposite lid section. The engagement of the diagonal portions 31 and 32 provide a dovetail-type of connection which prevents shifting of the lid sections in a horizontal plane relative to one another.

To accommodate the recessed flaps 26, the portion of the rim 7 located along each end wall 4 of the container has a depressed or recessed section 33. When the lid sections are in the closed position, as best illustrated in FIG. 6, the recessed flaps 25 are received within the respective recesses 33.

To provide an additional lock for the lateral edges of the lid sections 2 to the rim 7, the lower surface of each flap 25 is provided with an elongated projection 34 which is adapted to be received within a hole 35 in the underlying flap 26 and in a hole 36 in the rim 7, as illustrated in FIG. 6.

In order to lock the lid sections 2 to the container 1 through use of a security device, such as a padlock, holes 37, 38 and 39 are provided in the flap 25, the underlying flap 26 and the rim 7, respectively. When the lid sections are closed, the holes 37, 38 and 39 are in axial alignment, as illustrated in FIG. 6, and can receive a padlock or other security device, not shown.

The free longitudinal edge of each of the recessed flaps 26 of lid sections 2 is provided with semi-circular notches 40 which are in transverse alignment with the holes 30. The lid sections are flexible, being preferably formed of thermoplastic materials, and the tabs 25 and 26 are flexed and interfitted as the lids are pivoted to the horizontal closed position. The notches 40 receive the projections 29 as the lid sections are pivoted and facilitate alignment and sliding of the projections so that they can be inserted into the holes 30.

When the lid sections 2 are in the closed position they present a flat planar surface which can support an upper stacked container. To prevent lateral and longitudinal displacement of the upper stacked container, a series of upwardly extending curbs or projections 41 are provided on each lid section 2 along with a series of curbs 42. The curbs 41 and 42 are located outwardly of the bottom of the upper stacked container and prevent the container from being displaced longitudinally. Similarly, a series of projections 43 extend upwardly from each lid section 2 and restrain the upper stacked container against lateral displacement.

To enable each lid section to be pivoted to the downwardly hanging vertical position, the rim 7 is provided with openings 44 which receive the projections 43 so that the lid section can be pivoted to the downwardly hanging vertical position.

The container of the invention is compatible with a banding system in which a band or strap 45 is secured around the container and locked or sealed. The bands 45 are adapted to pass through the interruptions between the hinge members 14 and 16 so that the bands will lie flat against the upper surface of the closed lid sections 2 and will not interfere with a second container stacked on the lower container. The projections 43 serve a dual function in not only serving as curbs to prevent displacement of the upper stacked container, but each pair of projections 43 also serves to properly locate the band or strap 45.

The invention provides a security type container having integral hinged lid sections that can be locked in the closed position to completely enclose the open upper end of the container. In addition, the lid sections can be pivoted to a downwardly hanging storage position where they will not interfere with nesting of the containers. As a further advantage, the lid sections can be locked or held in a vertical open position to facilitate insertion or removal of materials from the container.

The flaps 25 and 26, along with the dovetail portions 31 and 22 provide interlocking planes that block movement of the closed lid sections in a horizontal direction, and the interfitting tabs 27 function as a center interlock to prevent snagging and forced entry of the container.

The container is compatible with banding systems and the interruptions in the hinge connections enable the bands to lie flat against the upper surface of the closed lis sections so that the band will not interfere with stack of upper containers.

The downwardly extending side flanges 28 in conjunction with the locking projections 29 and holes 30, and the dovetail connection 31 and 32 prevent inward slippage of the lid sections due to centrally applied weights on the lid sections. These features cooperate to insure that the lid will not slip and will remain in locking engagement with the rim of the container.

As each lid section has only a pair of interlocking flaps 25 and 26, as opposed to a multiplicity of flaps or tabs, the opening and closing is facilitated and less cumbersome.

While the drawings have illustrated the invention as associated with a nesting container having downwardly tapered walls, it is contemplated that the lid construction can be used with non-nesting containers having vertical walls and with containers having various configurations.

Various modes of carrying out the invention are contemplated as being within the scope of the following claims particularly pointing out and distinctly claiming the subject matter which is regarded as the invention.

I claim:

1. A container assembly, comprising an open-top container having a generally vertical wall and a bottom connected to the lower end of the wall, a pair of lid sections each having a first edge hinged to the upper edge of the vertical wall and having a second edge disposed opposite said first edge, said lid sections disposed to pivot from a downwardly hanging storage position to a generally horizontal closed position, a first flap member disposed on the second edge of each lid section and projecting laterally of said second edge beyond the center line of the container and extending approximately one-half the longitudinal length of said second edge, a second flap member disposed on the second edge of each lid section and extending approximately one-half the length of said second edge, said second flap member being recessed relative to the outer surface of each lid section and said outer surface being substantially at the same level as the upper edge of the vertical wall when the lid section is in the closed position, the first flap member of one of the lid sections disposed to overlie the second flap member of the other lid section when the lid sections are in the closed position, whereby the closed lid sections provide a substantially flat upper supporting surface, and projection means extending upwardly from the upper surfaces of the closed lid sections for preventing displacement of an upper container stacked on said closed lid sections.

2. The container assembly of claim 1, and including hinge means for hinging each lid section to the wall of the container, the hinge means for each lid section having at least one interruption to receive a strap adapted to lock the lid sections in the closed position.

3. The container assembly of claim 2, wherein said hinge means includes a first hinge member connected to the container and a second hinge member connected to the respective lid section, said first and second hinge members having aligned openings, and a hinge pin disposed within the aligned openings and extending across the interruption in the hinge means, said hinge pin is provided with a downwardly offset portion disposed in said interruption.

4. The container assembly of claim 1, and including a projection disposed on the undersurface of the first flap member of each lid section, said projection being received within an opening in the second flap member of the other lid section when the lid sections are in the closed position.

5. The container assembly of claim 1, wherein said projection means includes an upstanding curb arranged in a configuration to receive the bottom of an upper stacked container.

6. The container assembly of claim 6, wherein said curb constitutes elongated ridges.

7. The container assembly of claim 1, and including hinge means for connecting each lid section to the wall of the container, each hinge means being provided with at least one interruption to receive a strap for locking the lid sections in the closed position, said projection means including a pair of spaced projections with the space between the projections being aligned with said interruption whereby a strap passing through the interruption will extend between said spaced projections.

8. The container assembly of claim 1, wherein the vertical wall is rectangular in shape and said first and second edges are generally parallel, each lid section also has a pair of end edges connecting the first and second edges, said end edges resting on the upper edge of the vertical wall of the container.

9. The container assembly of claim 8, and including a downwardly extending flange connected to each end edge and disposed outwardly of the upper end of said vertical wall when the lid sections are in the closed position.

10. A container assembly, comprising a container having a pair of side walls, a pair of end walls, and a bottom wall connected to the lower edges of the side walls and end walls, said container also having a rim extending along the upper edges of the side walls and end walls, a pair of lid sections hinged to the upper edges of the opposed side walls and disposed to pivot from a downwardly hanging storage position to a generally horizontal closed position, each lid section having a first longitudinal edge hinged to the upper edge of the respective side wall and having a second longitudinal edge and a pair of end edges connecting said first and second longitudinal edges, a first flap member disposed on the second longitudinal edge of each lid section and projecting laterally beyond the center line of the container and extending approximately one-half the longitudinal length of said second edge, a second flap member disposed on the second longitudinal edge of each lid section and extending approximately one-half the length of said second edge, said second flap member being recessed relative to the outer surface of the respective lid section, the first flap member of one of the lid sections disposed to overlie the second flap member of the other lid section when the lid sections are in the closed position, whereby the closed lid sections provide a substantially flat upper supporting surface to support an upper stacked container, a tab projecting longitudinally from the inner longitudinal end of each first flap member, the tab on each lid section disposed to overlie the longitudinal inner end portion of the second flap member of the other lid section when the lid sections are in the closed position to provide an interlock of the lid sections at the center of the container.

11. A container assembly, comprising an open top container having a vertical wall and a bottom connected to the lower end of the vertical wall, a pair of lid sections each having a first longitudinal edge hinged to the upper end of the vertical wall and having a second longitudinal edge disposed opposite said first edge and a pair of end edges connecting the longitudinal edges, said lid sections disposed to pivot from a downwardly hanging storage position to a generally horizontal closed position, a first flap member disposed on the second longitudinal edge of each lid section and projecting laterally of said second edge, a second flap member disposed along the second longitudinal edge of each lid section and being recessed relative to the outer surface of the lid section, the first flap member of one of the lid sections disposed to overlap the second flap member of the other lid section when the lid sections are in the closed position whereby the closed lid sections provide an upper supporting surface for a container to be stacked thereon, said container also including a rim connected to the upper end of the vertical wall with said rim including a generally horizontal surface, the overlapping end edges of the flap members being supported on the horizontal surface of the rim when the lid sections are in the closed position, a downwardly hanging flange disposed on the end edge of each lid section and located outwardly of said rim when the respective lid section is in the closed position, the overlapping portions of the first and second flap members having aligned openings disposed in alignment with an opening in said rim, whereby a security device can be inserted through the three aligned openings to lock the lid sections to the container.

12. The container assembly of claim 11, wherein the horizontal surface of the rim is offset downwardly to receive the recessed flap of the respective lid section.

13. The container assembly of claim 11, in which the end of each first flap member is provided with a diagonal edge and the end of each recessed second flap member is also provided with a diagonal edge disposed to mate with the diagonal edge of the first flap member of the opposite lid section when the lid sections are in the closed position to provide a dove-tail type of connection between the closed lid sections.

14. The container assembly of claim 11, wherein the container includes a rim having a downwardly extending flange connected to the upper edge of the vertical wall, and said assembly includes a series of upstanding projections disposed on the upper surface of each lid section and serving as curbs to prevent displacement of a container stacked on the closed lid sections, said flange being provided with openings to receive the projections when the respective lid section is pivoted to the downwardly hanging vertical storage position.

15. The container assembly of claim 11, and including means associated with the hinge connection of each lid section to the container for holding the respective lid section in an upwardly extending generally vertical open position.

16. The container assembly of claim 11, in which the outer longitudinal end of each first flap member is provided with a diagonal edge and the end of each recessed second flap member is also provided with a diagonal edge disposed to mate with the diagonal edge of the first flap member of the opposite lid section when the lid sections are in the closed position to provide a dovetail type of connection between the closed lid section.

* * * * *

UNITED STATES PATENT AND TRADEMARK OFFICE

CERTIFICATE OF CORRECTION

PATENT NO. : 4,161,261

DATED : July 17, 1979

INVENTOR(S) : JAMES J. FRATER

It is certified that error appears in the above-identified patent and that said Letters Patent are hereby corrected as shown below:

Column 7, Line 3 (CLAIM 6) Cancel "claim 6" and substitute therefor ---claim 5---

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*